US005194100A

United States Patent [19]

DeHaven et al.

[11] Patent Number: 5,194,100

[45] Date of Patent: Mar. 16, 1993

[54] HEAT TREATABLE CHROMIUM

[75] Inventors: John DeHaven, Aloha; John Dash, Portland, both of Oreg.

[73] Assignee: Blount, Inc., Montgomery, Ala.

[21] Appl. No.: 653,022

[22] Filed: Feb. 8, 1991

[51] Int. Cl.[5] ..... C25D 3/06; C25D 5/50

[52] U.S. Cl. ..... 148/518; 205/227; 205/287; 205/289

[58] Field of Search ..... 204/37.1, 51; 205/224, 205/227, 287, 288, 289; 148/518

[56] References Cited

U.S. PATENT DOCUMENTS

| | | | |
|---|---|---|---|
| 3,771,972 | 11/1973 | Schaer et al. | 29/196.6 |
| 3,909,372 | 9/1975 | Fujii | 204/51 |
| 3,917,517 | 11/1975 | Jordan et al. | 204/43 P |
| 3,951,759 | 4/1976 | Studer | 204/32.1 |
| 4,447,299 | 5/1984 | Kasaaian et al. | 204/43 |
| 4,460,438 | 7/1984 | Tardy et al. | 204/51 |
| 4,615,773 | 10/1986 | Dash et al. | 204/43.1 |
| 4,690,735 | 9/1987 | Laitinen et al. | 204/37.1 |

OTHER PUBLICATIONS

Dash and DeHaven, "Plating of Heat Treatable Hard Chromium," *Plating and Surface Finishing*, p. 39 (Nov. 1989).

Hoshino et al., "The Electrodeposition and Properties of Amorphous Chromium Films Prepared from Chromic Acid Solutions," *J. Electrochem. Soc.* 133:681–685 (1986).

Hyashi, "From Art to Technology: Developments in Electroplating in Japan," *Plating and Surface Finishing* 30–41 (Sep. 1991).

*Primary Examiner*—John Niebling
*Assistant Examiner*—William T. Leader
*Attorney, Agent, or Firm*—Klarquist, Sparkman, Campbell, Leigh & Whinston

[57] ABSTRACT

A method for depositing chromium on metal substrates is disclosed in which the chromium hardens when heated. The electrolytic plating bath includes water soluble Cr(III), a sulfate catalyst, a metal ion buffer, and sufficient amounts of a reducing agent such as methanol to reduce substantially all Cr(VI) to Cr(III). The heat-hardenable chromium deposit allows the plated substrate to be heat tempered after plating, which eliminates the necessity of removing oxidation products from an unplated heated substrate. Moreover, the amount of toxic Cr(VI) present in the bath is greatly diminished, and replaced with a Cr(III) species that is environmentally safer.

7 Claims, 2 Drawing Sheets

HEAT TREATABLE CHROMIUM

BACKGROUND OF THE INVENTION

1. Field of the Invention

This invention concerns chromium plated cutter elements for saws and other cutting instruments, including chainsaws. More specifically, it concerns a method of electroplating chromium metal on cutter element substrates.

2. General Background of the Invention

Many types of electrolytic plating solutions have been developed to deposit chromium electrochemically on a metal substrate. One of the most widely used solutions contains predominantly hexavalent chromium ions (CrVI), in the form of dissolved chromium trioxide ($CrO_3$), which is mixed with water and a sulfate catalyst to produce a lustrous protective or decorative chromium plate. It has long been known that a predominantly hexavalent chromium ion solution produces a brighter, more lustrous thick plated product than a trivalent solution. Moreover, trivalent chromium ions have been considered undesirable in such solutions because they are thought to produce an ionic shield around the cathode in an electrolytic bath that inhibits electrodeposition of chromium. For these reasons, significant amounts of trivalent chromium have been considered an undesirable contaminant in chromium electroplating solutions.

More recently, U.S. Pat. Nos. 4,447,229 and 4,615,773 disclosed electrolytic plating bath solutions that contained both trivalent and hexavalent chromium. The current efficiency of these electroplating processes was improved by adding small amounts of methanol to a bath containing dissolved $CrO_3$ electrolyte. This bath promoted rapid electrodeposition of a chromium plate, even in the absence of a catalyst, with greater uniformity of the plated product. Particularly good current efficiency was observed when the bath contained dissolved metallic ions, such as iron, Current efficiency was also enhanced by maintaining the pH at the cathode at about 2.0 with a metal ion buffer.

Although chromium plating processes have long been known, the versatility of industrial processes using such plating has been limited by the observation that chromium softens when heated. Such heat softening is a particular problem in production processes that plate chromium on a heat-hardenable substrate such as an alloy steel. In the production of cutter elements, for example, it is necessary to heat-harden an alloy steel substrate before electrochemically plating the substrate with chromium to avoid softening the chromium during a heat treatment step. The necessity of heating the substrate prior to plating introduces an additional costly step into the manufacturing process. The surface of the steel substrate oxidizes when heated and must be thoroughly cleaned with a caustic material or other cleaning agents prior to plating. If such a cleaning step is not performed prior to plating, the chromium metal does not adhere well to the underlying steel substrate.

Another drawback to conventional electrodeposited chromium plate is that hydrogen is evolved at the cathode and incorporated into the chromium metal. Hydrogen can then diffuse from the plated metal into an alloy steel substrate and may embrittle the metal alloy. The plated chromium can be heated to 500°-650° C. to evolve hydrogen avoid such embrittlement, but such heating unacceptably softens the chromium plate.

Lower heat treatment temperatures can avoid chromium softening, but require prolonged periods of heating. Hence, prevention of hydrogen embrittlement of the substrate cannot be avoided by heat treatment without concomitantly sacrificing hardness of the chromium plate or prolonging the manufacturing process.

Yet another problem encountered in chromium electroplating is that conventional electrolytic baths contain high concentrations of hexavalent chromium ions, which are extremely toxic. The disposal of hexavalent chromium is subject to strict and costly environmental regulations that greatly increase the expense of electroplating processes. Although it would be desirable to reduce the amount of hexavalent chromium ions in the bath, such reduction has been considered unadvisable because it produces a dull product which is not suitable for decorative or engineering purposes. The trivalent species has also been considered a contaminant in a predominantly hexavalent bath. U.S. Pat. No. 4,615,773, for example, required neutralization of trivalent chromium in a hexavalent solution to allow electroplating to occur. In view of the belief that trivalent chromium is an unwanted contaminant, the amount of hexavalent ion used in electrolytic solutions has not been decreased. Moreover, large amounts of methanol have not been added to chromium electrolyte baths because the methanol was known to produce trivalent chromium ions, as in U.S. Pat. No. 4,447,299.

It is an object of this invention to provide a process for electrolytic deposition of chromium that is environmentally safer than previous processes.

Another object of the invention is to provide such a process that can eliminate the necessity for cleaning oxidation products produced by heating a substrate before electroplating.

Yet another object is to provide such a process that produces chromium plated cutters which harden or maintain their hardness when heated, and display excellent wear characteristics.

Finally, it is an object of the invention to provide a product having superior adhesion between the chromium plate and underlying substrate.

These and other objects of the invention will be understood more clearly by reference to the following detailed description and drawings.

SUMMARY OF THE INVENTION

The foregoing problems have been overcome by providing an aqueous electrolytic plating bath that contains trivalent chromium ions, but is preferably substantially free of hexavalent chromium ions. Chromium metal is electroplated from this bath on a cutter element substrate, and the plated substrate is then heated to increase the hardness of the substrate. In preferred embodiments, heating temperatures are chosen that harden the chromium as well as the substrate.

The process of the present invention has both environmental and manufacturing advantages. Avoiding or reducing the concentration of hexavalent chromium ions simplifies complying with environmental regulations which require specialized disposal of hexavalent chromium as a toxic waste. The heat treatable chromium also permits heat treatment of steel cutters which have already been plated, thereby avoiding the manufacturing step of cleaning oxidation products off bare steel cutters which are heat treated before plating. Finally, heat treating the chromium cutters may improve adhesion of chromium metal to the substrate because mutual molecular diffusion can occur between the chromium and steel layers during heating.

In especially preferred embodiments of the invention, the bath is prepared by reducing a water-soluble hexavalent chromium compound substantially completely to trivalent chromium with methanol. To achieve substantial reduction of all hexavalent chromium in a conventional bath, the amount of methanol should be 80 ml/liter, or about 3 grams $CrO_3$ to 1 ml methanol. Alternatively, formic acid is added to a trivalent chromium ion bath to reduce substantially all Cr(VI) to Cr(III) and form a heat-hardenable product. A water-soluble iron compound and sulfuric acid are preferably added to the solution to facilitate chromium deposition by buffering the pH to between 0.5 and 2.0. If the pH at the cathode rises above about 2.0, iron will precipitate as $Fe(OH)_3$, thus reducing the pH to the optimum operating range. A sulfate catalyst is preferably added to the solution in a ratio of at least 1:1 by concentration of sulfate to trivalent chromium ion to facilitate the reaction of the cathode.

The heat treatment step preferably involves heating the plated alloy steel substrate to 600°-1675° F., then reducing the temperature to a lower temperature. In especially preferred embodiments, the plated substrate is austempered without reducing hardness of the chromium plate by heating the plated substrate to at least 1300° F., preferably 1675° F., followed by rapid quenching in molten salt at 545° F. The quenched substrate is held at this lower temperature for a sufficient period of time to harden the substrate, for example one hour. In other preferred embodiments, the plated substrate is heated to about 900°-1100° F., most preferably 1000° F., for a sufficient period of time such that both the substrate and chromium harden.

In other embodiments, electrolytic plating is performed with an anode made of a non-reactive material, such as platinum and/or carbon, that does not oxidize $Cr^{3+}$ to $Cr^{6+}$ as easily as conventional lead anodes. Electroplating is preferably performed by providing electrical current in pulses with a current density of 0.4 to 6.5 amperes per square inch, preferably 0.4 to 1.2 amperes per square inch, most preferably 0.4 to 0.8 amperes per square inch.

DETAILED DESCRIPTION OF PREFERRED EMBODIMENTS

Conventional processes for making chromium plated cutters begin by forming a substrate, typically alloy steel, into the form of a cutter element. The formed substrate is then degreased and hardened by an austempering process in which the substrate is first heated briefly to about 1300°-1700° F. and then immersed in molten salt at a lower temperature preferably less than 700° F. for a longer period of time. The rate of decrease in temperature between the higher temperature and molten salt environment is important. A relatively quick quench on the order of one second, for example, provides excellent hardening of the steel substrate. During the heat-hardening step, the surface of the alloy steel substrate is covered by oxidation products which must be removed by rinsing and vigorous cleaning. After cleaning, the substrate is then placed in an electroplating vessel which contains an aqueous solution of hexavalent chromium. Reverse electrical current is supplied through the cathode to briefly de-plate the cutters, then polarity is reversed and direct electrical current is supplied to the anode to plate the cutters with a thin covering of chromium. The coated chromium cutters are next rinsed, shot peened, ground and assembled into a saw chain. Examples of chainsaws having chains with cutters suitable for chromium plating are disclosed in U.S. Pat. No. 4,776,826 and pending application Ser. No. 07/577,258, filed Sep. 4, 1990.

In the method of the present invention, the substrate is formed into a cutter element and degreased. Instead of heat-hardening the bare substrate, however, the substrate is directly plated with chromium metal from a Cr(III) bath that is substantially free of Cr(VI). The plated substrate is then heat-hardened, which removes hydrogen from the chromium metal and thereby diminishes hydrogen embrittlement of the steel substrate. The necessity for cleaning oxidized by-products from the surface of the substrate is also eliminated because heating occurs after electroplating. Heating of the already electroplated substrate is made possible by providing a chromium plate which retains or increases its hardness when heated. The electroplated substrate is then shot peened, ground and assembled into a saw chain for use in a power actuated cutting device, such as a chainsaw.

Figure 1:
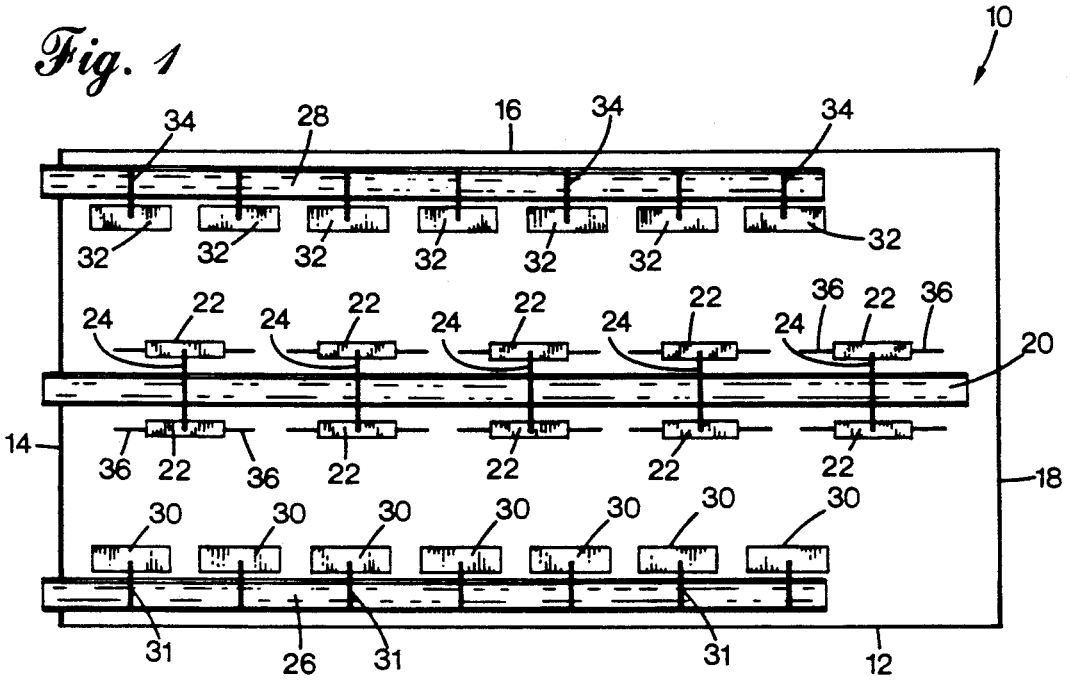
FIG. 1 is a top plan schematic view of an electroplating vessel constructed in accordance with the present invention.

FIG. 1 schematically illustrates an electroplating vessel 10 having sidewalls 12, 14, 16, 18 with internal faces that are plastic coated. An electrically conductive cathode support member 20 extends longitudinally across vessel 10 and supports a series of plastic coated cutter holders 22 which are suspended from member 20 by electrical conductors 24. A pair of parallel electrically conductive anode support members 26, 28 extends longitudinally across vessel 10 adjacent sidewalls 12, 16. Member 26 supports a series of anodes 30 each of which is suspended from member 26 by an electrical conductor 31. Member 28 similarly supports a series of anodes 32 suspended from electrical conductors 34.

Figure 2:
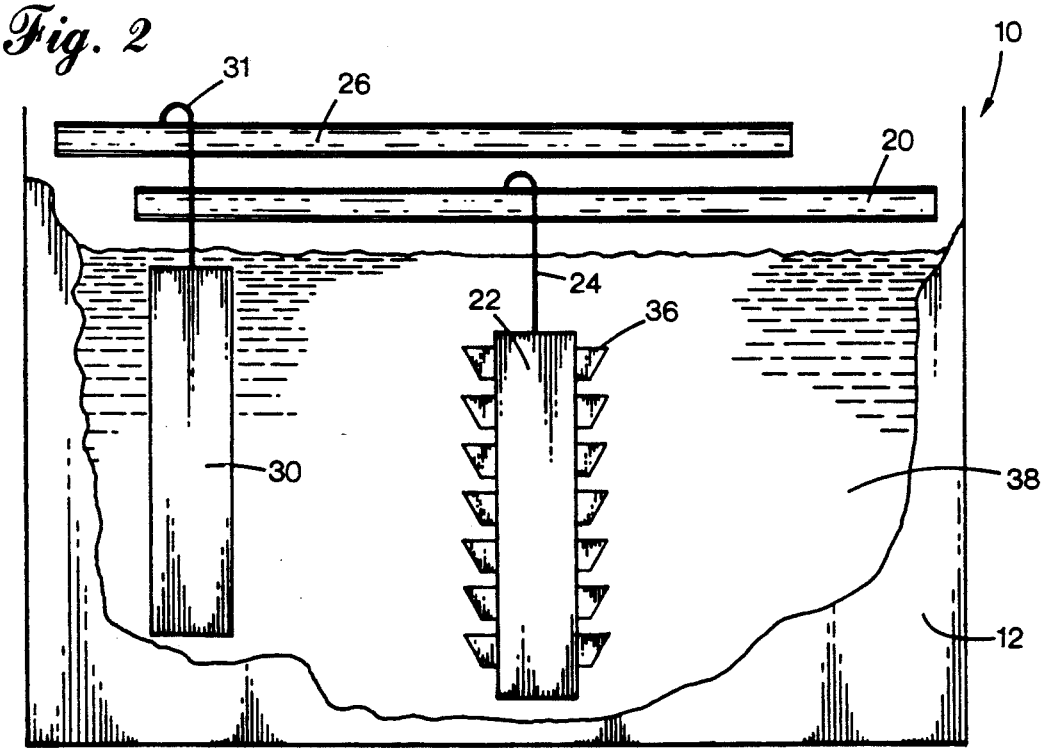
FIG. 2 is a side view of the electroplating vessel of FIG. 1, portions of the front sidewall of the vessel being broken away to illustrate the contents of the vessel, only one anode and one cathode being shown for clarity.

FIG. 2 schematically illustrates a single anode 26 and single cutter holder 22 suspended in a vessel 10. Holder 22 is plastic coated to prevent electrodeposition of chromium on it. A series of exposed electrical conductors (not shown) are provided inside holder 22 to provide electrical current to cutters 36 during electroplating. A series of cutter element substrates 36 are placed in holder 22 in conductive contact with the exposed electrical conductors, and a conventional source of electrical energy is supplied through cathode support member 20 and conductor 24. Cutter substrates 36 serve as cathodic electrodes in the electrolytic plating process. Vessel 20 contains an electroplating solution 38 that is described in the following Example I.

EXAMPLE I

Electroplating was performed in a vessel 20 containing 5 gallons of plating bath solution. The stainless steel substrate was a cutter element such as that shown in U.S. Pat. No. 4,776,826. Each element had a plated surface area of 0.15 sq. in. per item, which corresponded to the top and side plate of the cutter. The five-gallon electrolytic plating bath solution was prepared from a chromium electrolyte by combining 3.2 kg $CrO_3$, water and a suitable sulfate catalyst in vessel 10. 800 mls of methanol were added to substantially completely reduce Cr(VI) to Cr(III), followed by addition of 3.8 g of $H_2SO_4$ to provide sulfate ion as a catalyst and 560 g of $FeSO_4.7H_2O$ as a source of metal ion buffer. The final composition of the bath is given in Table 1 below:

TABLE 1

| | Amount (Ounces/Gallon) |
|---|---|
| Trivalent Chromium | 6.8 |
| Hexavalent Chromium | 2.8 |
| Iron | 0.76 |
| Sulfate | 25.4 |

After mixing and stabilization with the metal ion buffer, the pH was 1.2. Twenty-four samples of an alloy steel cutter substrate 36 were placed in rack 22 and electroplating was performed with a current density of about 0.5 to 0.8 amperes per square inch. The average current density of one run was 0.69 amperes per square inch with an average plating speed of 9.0 +/− 2.0 micro inches per minute. In a second run the average current density was 0.5 amperes per square inch with an average plating speed of 7.8 micro inches per minute. These low current densities minimized roughness on the curved substrates, but are not essential to making a heat hardenable chromium plate. The temperature of solution 38 was maintained at 65° F. +/− 3° F. without agitation during electroplating.

EXAMPLE II

The effect of heating the chromium plate was determined by performing micro hardness tests on the chromium deposits in the as-plated condition and after two different types of heat treatments. In the first heat treatment test, twenty-four plated cutters were heated to 1675° F. for 20 minutes, immediately after which the cutters were transferred to a molten salt medium in which they were heated at 545° F. for 60 minutes. In a separate run, twenty-four plated cutters were heated at 1000° F. for 30 minutes and then cooled to room temperature with no further heat treatment. Results for these two types of heat treatment are given in Table 2 below, and these results are compared to hardness of non-heat treated (as-plated) cutters. Hardness was determined by a conventional Knoop Hardness Machine in which a diamond shaped load weighing 25 g or 50 g was placed on a highly polished chromium plate, and then examined under a microscope. Results were expressed in terms of a Knoop Hardness Number (KHN).

TABLE 2

| Condition | | No. of Tests | KHN (25 g load) Av. KHN | Range |
|---|---|---|---|---|
| As-plated | Cr Deposit | 5 | 1140 | 947–1310 |
| | Steel Substrate | 5 | 617 | 519–716 |

TABLE 2-continued

| Condition | | No. of Tests | KHN (25 g load) Av. KHN | Range |
|---|---|---|---|---|
| Heated After Plating 1675° F. 20 min then 545° F. 60 min. | Cr Deposit | 4 | 1144 | 1044–1218 |
| | Steel Substrate | 4 | 691 | 569–848 |
| Heated After Plating 1000° F. 30 min | Cr Deposit | 3 | 1447 | 1409–1486 |
| | Steel Substrate | 3 | 835 | 785–889 |

The chromium plate maintained its hardness after heating at 1675° F. for 20 minutes and then at 545° F. for 60 minutes. The average Knoop hardness number (KHN) of the steel substrate actually increased from 617 to 691 in comparison to the unheated chromium plated substrate, even though the KHN of the chromium deposit did not change significantly. In contrast, when the freshly plated cutter was heated at 1000° F. for 30 minutes after plating, the average KHN of both the substrate and plate increased. The KHN of the chromium deposit increased from 1140 to 1447, while the average KHN of the steel substrate increased from 617 to 835. These results demonstrate that chromium plated from the plating solution of the present invention retains or increases its hardness when heated.

Figure 3:
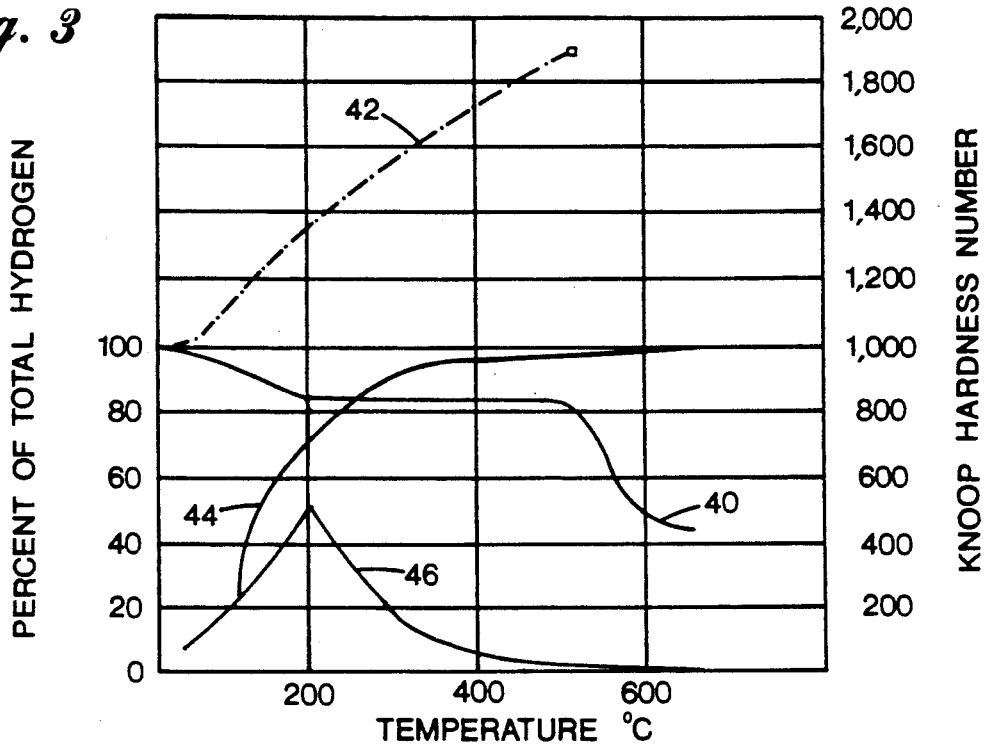
FIG. 3 is a graph showing variation in hardness and hydrogen content of electrodeposited chromium as a function of heat treatment temperature.

In contrast, chromium plate from a Cr(VI) bath softens when heated, as shown in the graph of FIG. 3. In that graph, line 40 indicates changes, with increasing temperature, in the hardness of chromium plated from a conventional hexavalent bath. Line 42 indicates hardness of chromium plating electrodeposited from the bath of Example I. Line 44 graphically represents the percent of total hydrogen evolved from a conventional Cr(VI) plating with increasing temperature, while line 45 represents the percent of total hydrogen evolved from such a plating at the indicated temperatures. Conventional Cr(VI) chromium deposit hardness decreases almost immediately with increasing temperature. At 540° C. (1000° F.) chromium deposited from a hexavalent bath has decreased appreciably in hardness, while chromium plated from the bath of Example I increases significantly after heating at that temperature. The chromium plated from the bath of Example I required heating to 913° C. (1675° F.) before its hardness was reduced to the as-plated KHN value. This was unexpectedly fortuitous because 1675° F. is the temperature preferred for austempering the steel alloy substrate. Hence, plating from the bath of Example I allows austempering to occur after rather than before plating.

Numerous potential benefits follow from heat treating after plating. Cleaning is no longer required before plating to remove oxidation products produced by heating bare substrates. Hydrogen embrittlement of the steel substrate is also diminished because heating the chromium reduces the hydrogen content of the plated metal. Hydrogen embrittlement of the chromium deposit is also decreased by heating. Finally, bonding of the chromium plate to the underlying steel substrate may be improved by interdiffusion between the deposit and substrate at the elevated temperature required for austempering.

EXAMPLE III

Figure 4:
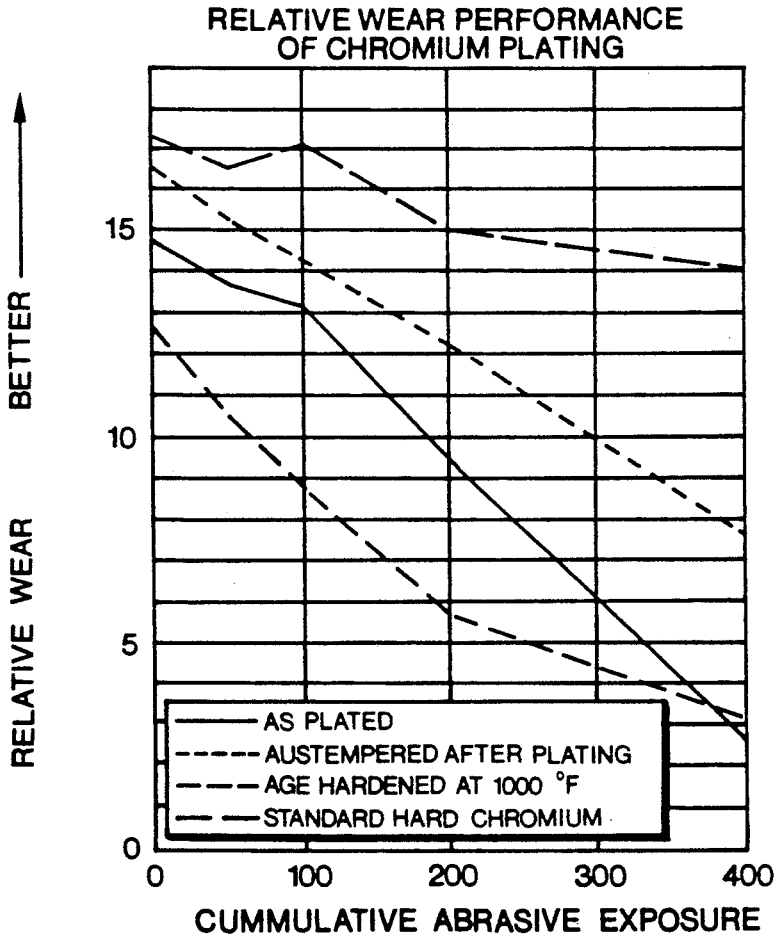
FIG. 4 is a graph showing the relative wear performance of chromium plating on a chainsaw, comparing the performance of chromium plated from a Cr(VI) bath to heat treated and non-heat treated chromium from a Cr(III) bath.

The woodcutting properties of saw chains made of cutters plated with the bath of Example I were compared with saw chains which incorporated cutters plated from a conventional hexavalent chromium bath. The results of these comparisons are shown in FIG. 4, which illustrates that chromium plating from a conventional hexavalent electrolytic bath has excellent wear properties. The performance characteristics of chromium plated in the bath of Example I depended on the type of heat treatment to which the plating was subjected. Austempering after plating provided a product having properties superior to chromium plated from a trivalent bath that was not heat-treated. Plating from the trivalent bath that was age-hardened at 1000° F. had greater relative wear with cumulative abrasive exposure. Chromium plated from the bath of Example I but that was not heat treated had wear characteristics intermediate the austempering and age hardened samples.

EXAMPLE IV

The effect of varying the amperage of the electroplating current was studied in eighteen runs of 24 cutters plated with the bath of Example I. The temperature of the bath was maintained at 70° F. for all electroplatings in this study. Results are shown in Table 3.

TABLE 3

| SAMPLE NO. | TIME mins | VOLTAGE VOLTS | CURRENT AMPS | CURRENT DENSITY (amps/sq. in) | TEMP DEG F. | pH | THICKNESS MICRO-IN | DEPOSIT RATE |
|---|---|---|---|---|---|---|---|---|
| 1 | 30 | 6.1 | 3.5 | 0.9690 | 70 | 0.77 | | — |
| 2 | 30 | 7.5 | 5.0 | 1.3843 | 70 | 0.76 | | — |
| 3 | 30 | 7.0 | 3.5 | 0.9690 | 70 | 1.20 | 200 | 5.83 |
| 4 | 30 | 7.0 | 3.5 | 0.9690 | 70 | 1.20 | 175 | 5.83 |
| 5 | 40 | 6.0 | 2.5 | 0.6921 | 70 | | 50 | 1.56 |
| 6 | 53 | 6.0 | 2.5 | 0.6921 | 70 | | 120 | 2.12 |
| 7 | 40 | 7.3 | 3.5 | 0.9690 | 70 | | 120 | 3.75 |
| 8 | 55 | 7.3 | 3.5 | 0.9690 | 70 | | 250 | 4.55 |
| 9 | 50 | 8.4 | 4.5 | 1.2458 | 70 | | | — |
| 10 | 50 | 8.4 | 4.5 | 1.2458 | 70 | | | — |
| 11 | 50 | 6.3 | 3.0 | 0.8306 | 70 | | 200 | 4.50 |
| 12 | 50 | 6.3 | 3.0 | 0.8306 | 70 | | 100 | 2.75 |
| 13 | 60 | 5.0 | 2.5 | 0.6921 | 70 | | 175 | 3.96 |
| 14 | 60 | 5.0 | 2.5 | 0.6921 | 70 | | 200 | 3.33 |
| 15 | 60 | 5.6 | 3.5 | 0.9690 | 70 | | 250 | 5.91 |
| 16 | 60 | 5.6 | 3.5 | 0.9690 | 70 | | 350 | 5.24 |
| 17 | 40 | 6.5 | 4.3 | 1.1905 | 70 | | | — |
| 18 | 36 | 6.5 | 4.3 | 1.1905 | 70 | | | — |

The degree of nodularity of the plate was sensitive to current density because lower current densities provided a smoother plated product having minimal nodularity. A current of 3.0–3.5 amperes yielded the most uniform coating. However, current densities between about 0.4 and 0.8 amperes per square inch of substrate plated were found to provide a particularly smooth product.

EXAMPLE V

The effect of heat treatment temperature on hardness of the chromium plate was further studied by electroplating chromium on alloy steel substrates using the solution described in Example I. Cutters were heat-treated in a pre-heated oven for one hour at the temperatures shown below, and deposit thickness was measured in the center of the plated cutter. The KHN values were measured with a Knoop Hardness Machine, and are shown in Table 4.

TABLE 4

| SAMPLE NUMBER | CR THICKNESS (MICRONS = IN) | TEMPERED AT (F.°) | FILAR UNITS (50 g) | KHN (50 g) | FILAR UNITS (25 g) | KHN (25 g) |
|---|---|---|---|---|---|---|
| 1 | 11.8 = 0.000456 | 525 | 132 | 1107 | 86 | 1310 |
| 2 | 8.0 = 0.000319 | 600 | 123 | 1275 | 70 | 1960 |
| 3 | 9.1 = 0.000358 | 700 | 120 | 1340 | 72 | 1860 |
| 4 | 8.6 = 0.000339 | 800 | 126 | 1220 | 74 | 1760 |
| 5 | 9.3 = 0.000366 | 900 | 120 | 1340 | 70 | 1960 |
| 6 | 8.2 = 0.000323 | 1000 | 113 | 1510 | 72 | 1860 |
| 7 | 8.3 = 0.000327 | *** | 143 | 944 | 97 | 1025 |

Chromium hardness was greater for all heat treated samples 1–6 as compared to untempered sample 7. Hardness was increasingly greater with higher temperatures from 525°–1000° F., with the most significant increase in hardness occurring within this range at 1000° F. The inventors believe that the precise degree of heat hardening at given temperatures will vary with the differing compositions of the electrolytic solutions of the present invention.

Another advantage of the present invention is shown in Table 4. The thickness of chromium plated from the bath exceeds 300 microinches, which is important in making a cutter element having suitable wear resistance properties. Prior trivalent baths have only been suitable for producing thin decorative chromium plate of less than about 200 microinches thickness. The present invention electrodeposits chromium plating thicker than 200 microinches, preferably greater than 300 microinches, most preferably 300–400 microinches.

EXAMPLE VI

Another plating bath was prepared, as in Example I, but the amounts of electrolytes, catalyst and buffer were varied such that the final composition of the bath was as shown in Table 5.

TABLE 5

| | g/L | g/L × 0.128 = ounces/gallon |
|---|---|---|
| Trivalent Chromium | 47.4 | 6.1 |
| Hexavalent Chromium | 2.6 | 0.3 |
| Iron | 8.4 | 1.1 |

TABLE 5-continued

| | g/L × 0.128 = ounces/gallon | |
|---|---|---|
| Sulfate | 69.8 | 8.9 |

TABLE 6

| | | |
|---|---|---|
| Trivalent Chromium | 31.2–156.2 | 4–20 |
| Hexavalent Chromium | 0–156.2 | 0–20 |
| Iron | 3.9–11.7 | 0.5–1.5 |
| Sulfate | 69.5–198.4 | 8.9–25.4 |

Within these ranges, hexavalent chromium is preferably zero. Sufficient methanol should be added to eliminate substantially all hexavalent chromium from the bath.

The actual mechanism which allows the plated product of the trivalent bath to harden with heating is unknown. The inventors believe, however, that formic acid is generated in the bath by the partial decomposition of methanol which is added as a reducing agent. Formic acid formation is believed to result in codeposition of carbon in the electroplated deposit that allows heat hardening to occur. The trivalent chromium may be complexed with carbon, and hence organic.

Another aspect of preferred embodiments of the present invention is the use of a non-reactive anode, such as platinum plated over a titanium mesh. Lead anodes were used in the prior art, but have been found to change the chemical equilibrium of the bath. These changes produce a sludge that fouls the anode and requires frequent cleaning or replacement of the anode. Moreover, nonreactive anodes do not oxidize $Cr^{3+}$ to $Cr^{6+}$, as well as lead, and therefore avoid production of $Cr^{6+}$ that then contaminates the bath. The platinum anode diminishes loss of $Cr^{3+}$ by oxidation at the anode.

The present invention is suitable for plating many types of cathode substrates, including nickel, low-carbon steel, iron, copper and others. Temperatures and times of heating the substrates will vary interdependently depending on the particular electrolytic bath employed. A reducing agent other than methanol, for example formic acid, is suitable for reducing Cr(VI) to Cr(III) in the practice of this invention. As used herein, the term "substantially free of hexavalent chromium ions" refers to an electrolytic solution having less than about 2.6 g/L hexavalent chromium, or wherein the ratio of the concentration of the trivalent to hexavalent species is 18 to 1 or greater. The temperature of the electrolytic bath during plating is maintained at between about 60°–140° F., and preferably between 60°–70° F. Finally, although the present invention contemplates eliminating the necessity for removing oxidation products from an unplated heated substrate, cleansing of the substrate prior to plating can still occur within the scope of this invention.

Having illustrated and described the principles of the invention in several preferred embodiments, it should be apparent to those skilled in the art that the invention can be modified in arrangement and detail without departing from such principles.

We claim:

1. A method of making cutter elements, comprising:
forming a substrate in the shape of a cutter element;
providing a plating bath comprising water soluble trivalent chromium, a sulfate catalyst, and a water soluble metal ion buffer that maintains the pH of the bath between 0.5 and 2.0, substantially all Cr(VI) in the bath being reduced to Cr(III) by addition of sufficient amounts of methanol or formic acid;
providing an anode in the bath, and placing the substrate in the bath to act as a cathode;
electroplating chromium metal onto the substrate by providing a current density of 0.4 to 6.5 amperes per square inch; and
heating the electroplated substrate to about 600°–1675° F. for a sufficient period of time to harden the substrate while retaining or increasing hardness of the plated chromium metal.

2. The method of claim 1 wherein the electroplating step comprises electroplating a chromium layer at least 200 microinches thick.

3. The method of claim 2 wherein the electroplating step comprises electroplating a chromium layer at least 300 microinches thick.

4. The method of claim 3 wherein the chromium layer is 300–400 microinches thick.

5. The method of claim 1 wherein the bath comprises about 47 g/L trivalent chromium, 2.6 g/L hexavalent chromium, 8.4 g/L iron, and 69.8 g/L sulfate.

6. The method of claim 1 wherein the bath comprises about 0 g/L hexavalent chromium.

7. The method of claim 1 wherein substantially all Cr(VI) in the bath is reduced to Cr(III) by addition of sufficient amounts of methanol.

* * * * *